US010755628B2

(12) United States Patent
Oulee et al.

(10) Patent No.: US 10,755,628 B2
(45) Date of Patent: Aug. 25, 2020

(54) DISPLAY APPARATUS AND VOLTAGE STABILIZATION METHOD

(71) Applicant: Raydium Semiconductor Corporation, Hsinchu (TW)

(72) Inventors: Chi-Hsiang Oulee, Taitung, Taitung County (TW); Tzong-Yau Ku, Hsinchu (TW); Jun-Ren Shih, Hsinchu (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 0 days.

(21) Appl. No.: 16/293,802

(22) Filed: Mar. 6, 2019

(65) Prior Publication Data

US 2019/0279562 A1 Sep. 12, 2019

Related U.S. Application Data

(60) Provisional application No. 62/640,061, filed on Mar. 8, 2018.

(51) Int. Cl.
*G09G 3/3208* (2016.01)

(52) U.S. Cl.
CPC ... *G09G 3/3208* (2013.01); *G09G 2310/0259* (2013.01); *G09G 2310/066* (2013.01)

(58) Field of Classification Search
CPC ..... G09G 3/3208; G09G 2310/0259; G09G 2310/0291; G09G 2310/066; G09G 2310/06
See application file for complete search history.

(56) References Cited

U.S. PATENT DOCUMENTS

2018/0254004 A1* 9/2018 Hsiao ..... G09G 3/20

* cited by examiner

*Primary Examiner* — Priyank J Shah

(57) ABSTRACT

A display apparatus including a voltage buffer, a display panel and a pixel loading compensation circuit is disclosed. The voltage buffer is used to receive a ramp voltage and output an output current. The display panel includes pixel switches and pixel capacitors. The pixel switches are arranged in parallel and coupled to the voltage buffer. The pixel capacitors are coupled between the pixel switches and ground. The pixel loading compensation circuit includes compensation switches and compensation current sources. The compensation switches corresponding to the pixel switches are arranged in parallel and coupled to the voltage buffer. The compensation current sources are coupled between the compensation switches and ground. The operation of the compensation switches is opposite to the operation of the corresponding pixel switches.

12 Claims, 3 Drawing Sheets

DISPLAY APPARATUS AND VOLTAGE STABILIZATION METHOD

BACKGROUND OF THE INVENTION

1. Field of the Invention

The invention relates to a display; in particular, to a display apparatus and a voltage stabilization method.

2. Description of the Prior Art

As shown in FIG. 1, in the conventional display apparatus using OLED On Silicon micro-display technology, a ramp voltage VRAMP provided by a ramp source driver is transmitted to each of the pixel capacitors CPX1~CPX4 through a voltage buffer VB. The pixel switches SW1~SW4 coupled between the pixel capacitors CPX1~CPX4 and the voltage buffer VB respectively will be turned off at correct time based on the data to be displayed by the display apparatus 1, so that correct voltage of each pixel can be sampled.

However, since the above operation mode will cause the capacitance value seen at the output terminal of the voltage buffer VB to constantly change, the voltage buffer VB needs to constantly calibrate the output current outputted by the voltage buffer VB to all pixels to maintain the same voltage slope.

In addition, the voltage buffer VB needs to control the output current ITL through the feedback network FBN. Since the operating bandwidth of the feedback network FBN has a certain upper limitation, when a certain pixel switch (for example, the second pixel switch SW2) is turned off, the output current ITL provided by the voltage buffer VB will be greater than the current required to maintain the same slope, thus causing a brief jitter of the output voltage VOUT of the voltage buffer VB (as the output voltage VOUT at the time T shown in FIG. 2). As for FIG. 3, the results of the actual simulation are shown. When the pixel switch is turned off at the time T, the output voltage VOUT of the voltage buffer VB will exhibit a brief jitter phenomenon, resulting in an unstable output voltage VOUT, which needs to be overcome.

SUMMARY OF THE INVENTION

Therefore, the invention provides a display apparatus and a voltage stabilization method to solve the above-mentioned problems of the prior arts.

A preferred embodiment of the invention is a display apparatus. In this embodiment, the display apparatus includes a voltage buffer, a display panel and a pixel loading compensation circuit. The voltage buffer is used to receive a ramp voltage and output an output current. The display panel includes pixel switches and pixel capacitors. The pixel switches are arranged in parallel and coupled to the voltage buffer. The pixel capacitors are coupled between the pixel switches and ground respectively. The pixel loading compensation circuit includes compensation switches and compensation current sources. The compensation switches corresponding to the pixel switches are arranged in parallel and coupled to the voltage buffer. The compensation current sources are coupled between the compensation switches and ground respectively. The operation of the compensation switches is opposite to the operation of the corresponding pixel switches.

In an embodiment, when a first pixel switch of the pixel switches is turned on, a pixel current flows from the voltage buffer to a first pixel capacitor, coupled in series with the first pixel switch, of the pixel capacitors, and a first compensation switch, corresponding to the first pixel switch, of the compensation switches is turned off In an embodiment, when a second pixel switch of the pixel switches is turned off, a second compensation switch, corresponding to the second pixel switch, of the compensation switches is turned on, so that a compensation current equal to the pixel current flows from the voltage buffer to a second compensation current source, coupled in series with the second compensation switch, of the compensation current sources, and there is no current passing through a second pixel capacitor, coupled in series with the second pixel switch, of the pixel capacitors.

In an embodiment, when the second pixel switch is turned off, the compensation current flowing from the voltage buffer to the second compensation current source is equal to the pixel current, so that an output voltage of the voltage buffer does not appear to be jittery.

In an embodiment, the ramp voltage is provided to the voltage buffer by a ramp source driver.

In an embodiment, the display panel is an organic light-emitting diode (OLED) panel.

Another preferred embodiment of the invention is a voltage stabilization method. In this embodiment, the voltage stabilization method is applied to a display apparatus. The display apparatus includes a voltage buffer, a display panel and a pixel loading compensation circuit. The display panel includes pixel switches and pixel capacitors. The pixel switches are coupled to the voltage buffer in parallel with each other, and the pixel capacitors are coupled between the pixel switches and ground respectively. The pixel loading compensation circuit includes compensation switches and compensation current sources.

The voltage stabilization method includes the following steps of: coupling the compensation switches, corresponding to the pixel switches, in parallel to the voltage buffer; coupling the compensation current sources between the compensation switches and ground respectively; and when the voltage buffer receives the ramp voltage and outputs an output current, the operation of compensation switches is opposite to the operation of corresponding pixel switches.

Compared to the prior art, the display apparatus and the voltage stabilization method of the invention can turn on the compensation switch corresponding to the pixel switch, so that the compensation current can flow from the voltage buffer to the compensation current source coupled to the compensation switch, and the compensation current will be equal to the pixel current flowing to the pixel capacitor, so that the output voltage of the voltage buffer has no jitter. Therefore, when each pixel switch performs voltage sampling, the voltage buffer does not need to calibrate its output current, so it can effectively achieve the effect of output voltage stabilization.

The advantage and spirit of the invention may be understood by the following detailed descriptions together with the appended drawings.

BRIEF DESCRIPTION OF THE APPENDED DRAWINGS

DETAILED DESCRIPTION OF THE INVENTION

A preferred embodiment of the invention is a display apparatus. In this embodiment, the display apparatus can use the organic light-emitting diode (OLED) on silicon micro-display technology, but not limited to this. The display apparatus can include a ramp source driver, a voltage buffer, a display panel and a pixel loading compensation circuit. In fact, the display panel can be an OLED panel, but not limited to this. The ramp source driver provides a ramp voltage to the voltage buffer. The voltage buffer receives the ramp voltage and provides an output current, but not limited to this.

Figure 1:
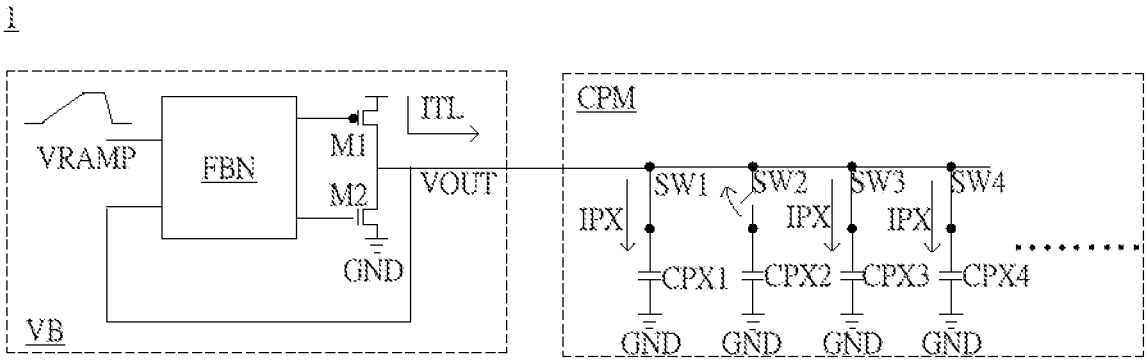
FIG. 1(Prior art)
FIG. 1 illustrates a schematic diagram of a ramp source driver in a conventional display apparatus providing a ramp voltage and transmitting the ramp voltage to each of the pixel capacitors in the display panel through a voltage buffer.
Figure 2:
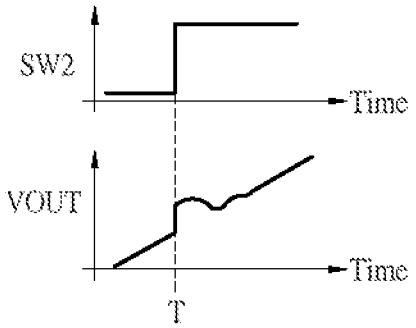
FIG. 2(Prior art)
FIG. 2 illustrates a schematic diagram showing that when the second pixel switch SW2 is turned off at the time T, the output voltage VOUT of the conventional voltage buffer exhibiting a brief jitter phenomenon.
Figure 3:
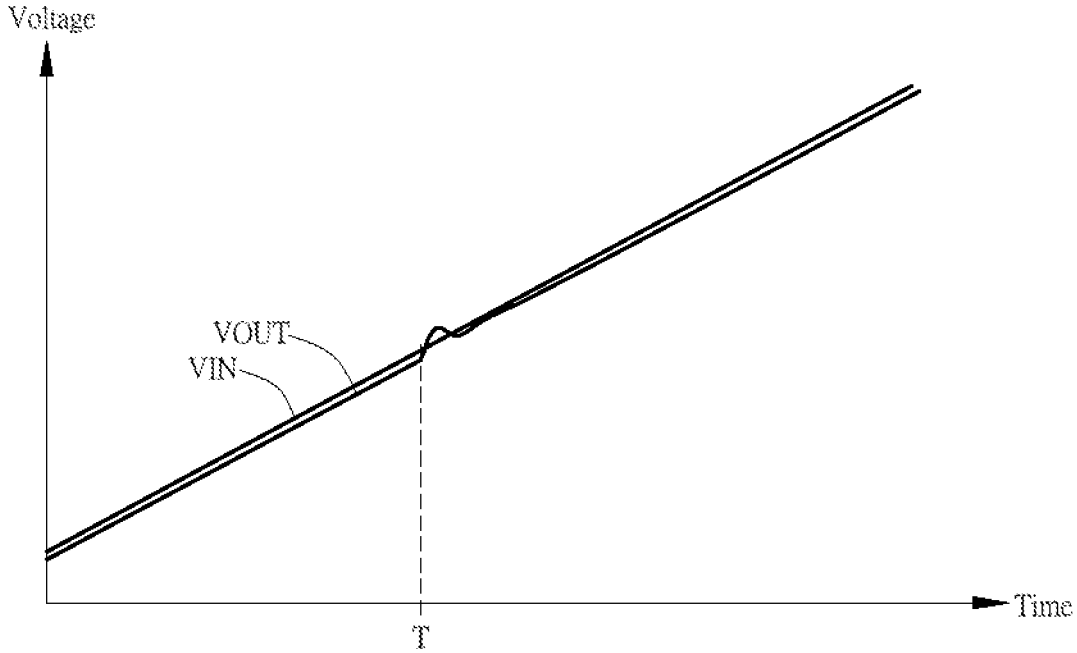
FIG. 3(Prior art)
FIG. 3 illustrates a schematic diagram showing that the output voltage VOUT of the conventional voltage buffer exhibiting a brief jitter after the time T in the actual simulation results.
Figure 4:
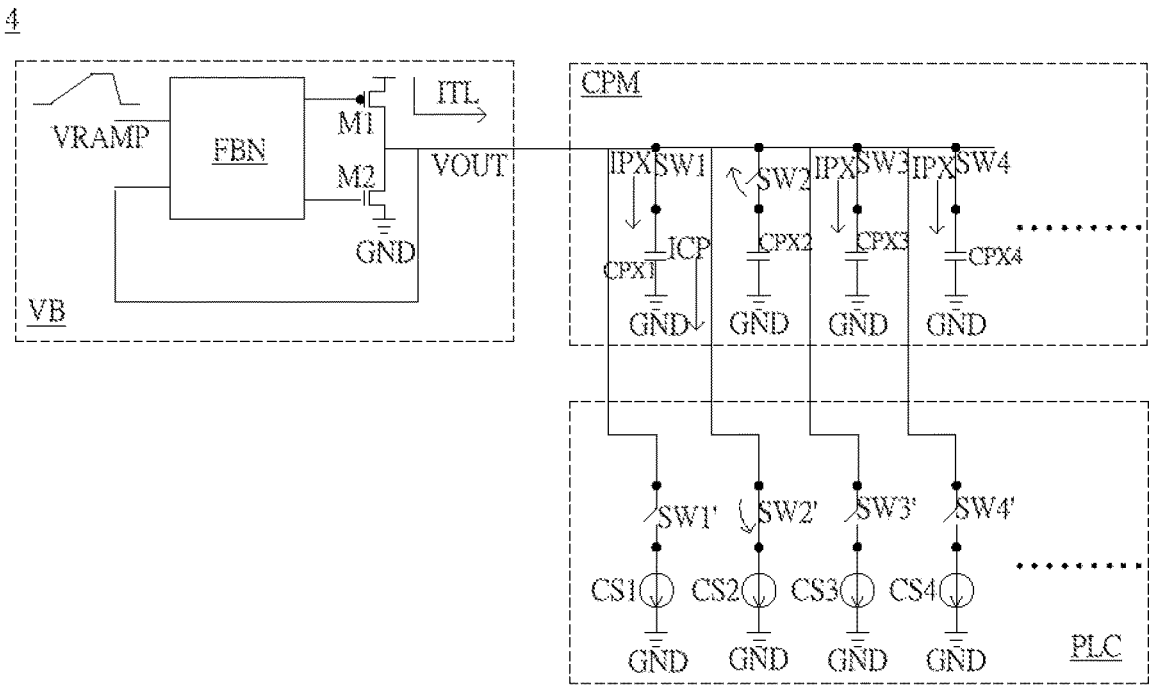
FIG. 4 illustrates a schematic diagram of the display apparatus in a preferred embodiment of the invention.

Please refer to FIG. 4. FIG. 4 illustrates a schematic diagram of the display apparatus in this embodiment.

As shown in FIG. 4, the display apparatus 4 can include a voltage buffer VB, a display panel CPM and a pixel load compensation circuit PLC. The voltage buffer VB is coupled to the display panel CPM; the display panel CPM is coupled to the pixel load compensation circuit PLC.

The voltage buffer VB is used to receive the ramp voltage VRAMP and output an output current ITL. The output terminal of the voltage buffer VB has an output voltage VOUT. In this embodiment, the voltage buffer VB includes a feedback network FBN, a first transistor M1 and a second transistor M2. The second transistor M2 is coupled between the first transistor M1 and the ground GND. The two output terminals of the feedback network FBN are coupled to the gates of the first transistor M1 and the second transistor M2 respectively. The two input terminals of the feedback network FBN are coupled to the ramp voltage VRAMP and between the first transistor M1 and the second transistor M2 respectively.

The display panel CPM includes pixel switches SW1~SW4 and pixel capacitors CPX1~CPX4. The pixel switches SW1~SW4 are coupled to the output terminal of the voltage buffer VB in parallel with each other, and the pixel capacitors CPX1~CPX4 are coupled between the pixel switches SW1~SW4 and the ground GND respectively.

That is to say, the first pixel switch SW1 is coupled between the output terminal of the voltage buffer VB and the first pixel capacitor CPX1. The second pixel switch SW2 is coupled between the output terminal of the voltage buffer VB and the second pixel capacitor CPX2. The third pixel switch SW3 is coupled between the output terminal of the voltage buffer VB and the third pixel capacitor CPX3. The fourth pixel switch SW4 is coupled between the output terminal of the voltage buffer VB and the fourth pixel capacitor CPX4. The rest can be deduced by analogy, and will not be described here.

The pixel load compensation circuit PLC includes compensation switches SW1'~SW4' and compensation current sources CS1~CS4. The compensation switches SW1'~SW4', corresponding to the pixel switches SW1~SW4, are coupled in parallel to the output terminal of the voltage buffer VB, and the compensation current sources CS1~CS4 are coupled between the compensation switches SW1'~SW4' and the ground GND respectively.

That is to say, the first compensation switch SW1' is coupled between the output terminal of the voltage buffer VB and the first compensation current source CS1. The second compensation switch SW2' is coupled between the output terminal of the voltage buffer VB and the second compensation current source CS2. The third compensation switch SW3' is coupled between the output terminal of the voltage buffer VB and the third compensation current source CS3. The fourth compensation switch SW4' is coupled between the output terminal of the voltage buffer VB and the fourth compensation current source CS4. The rest can be deduced by analogy, and will not be described here.

It should be noted that, in the invention, the operation of the compensation switches SW1'~SW4' and the corresponding operation of the pixel switches SW1~SW4 are opposite to each other.

Taking the first pixel switch SW1 and the first compensation switch SW1' corresponding to each other as an example, when the first pixel switch SW1 is turned on, a pixel current IPX flows from the voltage buffer VB to the first pixel capacitor CPX1. At this time, the corresponding first compensation switch SW1' is turned off, so that there is no current flowing from the voltage buffer VB to the first compensation current source CS1.

When the first pixel switch SW1 is turned off, there is no current flowing from the voltage buffer VB to the first pixel capacitance CPX1. At this time, the corresponding first compensation switch SW1' is turned on, so that the compensation current ICP will flow from the voltage buffer VB to the first compensation current source CS1.

Similarly, taking the second pixel switch SW2 and the second compensation switch SW2' corresponding to each other as an example, when the second pixel switch SW2 is turned on, the pixel current IPX flows from the voltage buffer VB to the second pixel capacitor CPX2. At this time, the corresponding second compensation switch SW2' is turned off, so that there is no current flowing from the voltage buffer VB to the second compensation current source CS2.

When the second pixel switch SW2 is turned off, there is no current flowing from the voltage buffer VB to the second pixel capacitance CPX2. At this time, the corresponding second compensation switch SW2' is turned on, so that the compensation current ICP will flow from the voltage buffer VB to the second compensation current source CS2.

As to the third pixel switch SW3 and the third compensation switch SW3' corresponding to each other, and the fourth pixel switch SW4 and the fourth compensation switch SW4' corresponding to each other, they can be deduced by analogy, and thus not be described here.

It should be noted that since the compensation current ICP is equal to the pixel current IPX, the capacitance value seen from the output terminal of the voltage buffer VB can be maintained. When each of the pixel switch SW1~SW4 performs voltage sampling, the voltage buffer VB does not need to calibrate its output current ITL, so that the effect of stabilizing the output voltage VOUT can be effectively achieved.

Figure 5:
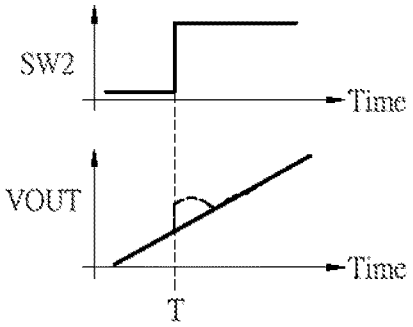
FIG. 5 illustrates a schematic diagram showing that when the second pixel switch SW2 is turned off at the time T, the output voltage VOUT of the voltage buffer of the invention will maintain the same slope without the jitter of the prior art.

Please refer to FIG. 5. When the second pixel switch SW2 is turned off at the time T, the output voltage VOUT (indicated by the solid line) of the voltage buffer VB of the invention will still maintain the same slope without the jitter phenomenon occurred in the prior art (indicated by a broken line), so that the disadvantages of the prior art can be effectively improved.

Figure 6:
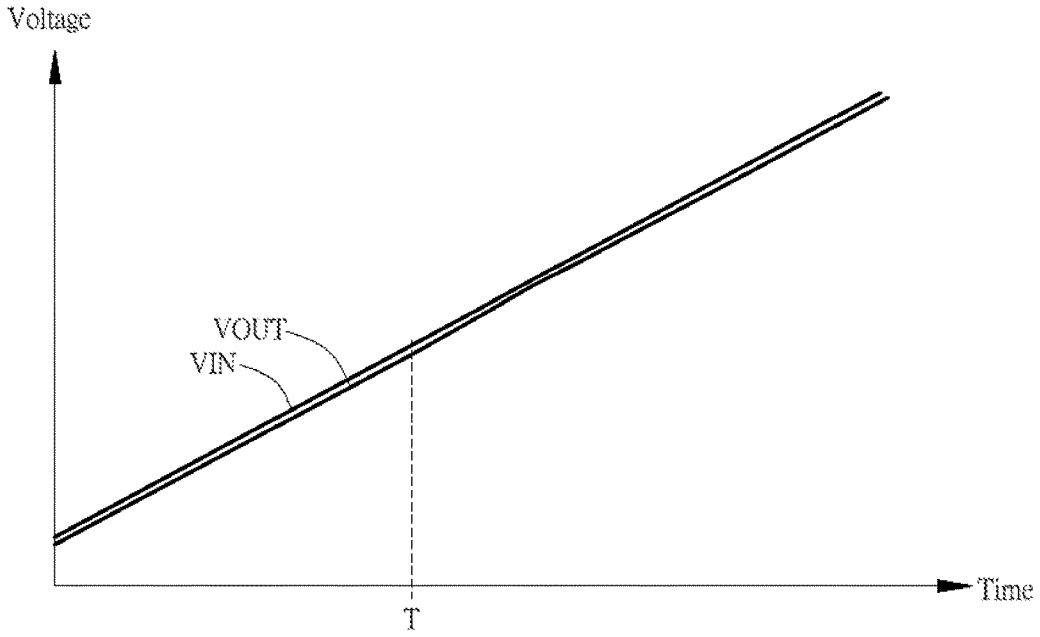
FIG. 6 illustrates a schematic diagram showing that in the actual simulation result, the output voltage VOUT of the voltage buffer will maintain the same slope after the time T without the jitter of the prior art.

Similarly, please refer to FIG. 6. In the actual simulation result, the output voltage VOUT of the voltage buffer VB will maintain the same slope after the time T when the pixel switch is turned off, so that the disadvantages of the jitter phenomenon occurred in the output voltage VOUT of the voltage buffer VB in the prior art can be effectively improved.

Another embodiment of the present invention is a voltage stabilization method. In this embodiment, the voltage stabilization method is applied to a display apparatus. The display apparatus can use the organic light-emitting diode (OLED) on silicon micro-display technology, but not limited to this. The display apparatus can include a ramp source driver, a voltage buffer, a display panel and a pixel loading compensation circuit. The display panel includes pixel switches and pixel capacitors. The pixel switches are coupled to the voltage buffer in parallel with each other, and the pixel capacitors are coupled between the pixel switches and ground respectively. The pixel loading compensation circuit includes compensation switches and compensation current sources.

In fact, the display panel can be an OLED panel, but not limited to this. The voltage buffer receives the ramp voltage and provides an output current, and the ramp voltage is provided to the voltage buffer by a ramp source driver, but not limited to this.

Figure 7:
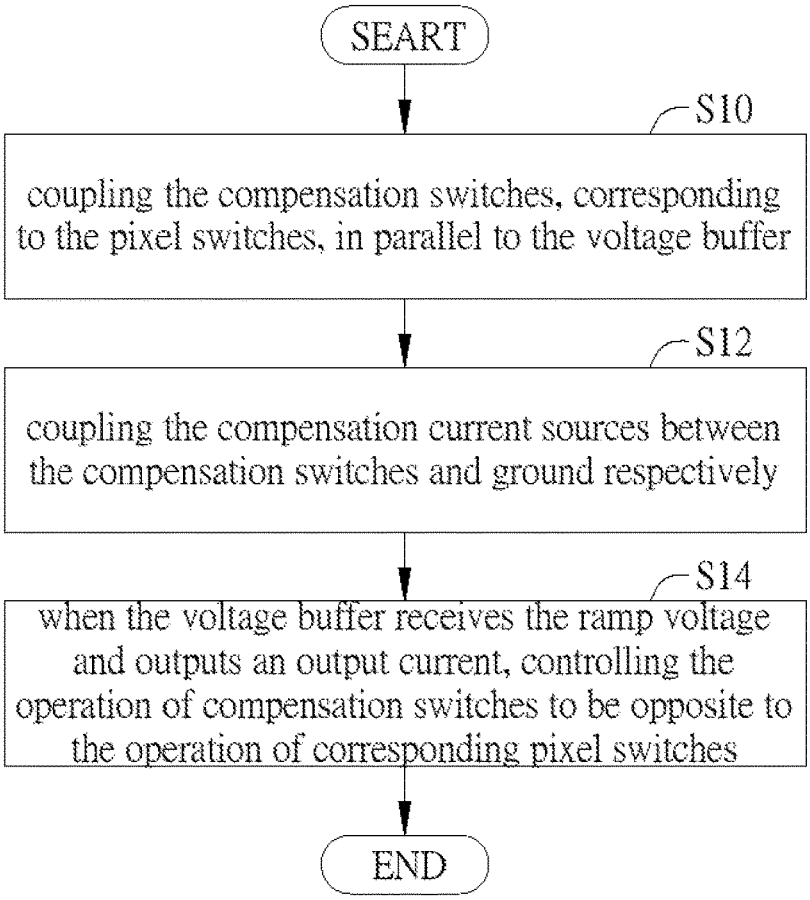
FIG. 7 illustrates a flowchart of the voltage stabilization method in another preferred embodiment of the invention.

Please refer to FIG. 7. FIG. 7 illustrates a flowchart of the voltage stabilization method in this embodiment.

As shown in FIG. 7, the voltage stabilization method can include the following steps including:

step S10: coupling the compensation switches, corresponding to the pixel switches, in parallel to the voltage buffer;

step S12: coupling the compensation current sources between the compensation switches and ground respectively; and step S14: when the voltage buffer receives the ramp voltage and outputs an output current, the operation of compensation switches is opposite to the operation of corresponding pixel switches.

In detail, when the first pixel switch of the pixel switches is turned on, the pixel current will flow from the voltage buffer to the first pixel capacitor, coupled in series with the first pixel switch, of the pixel capacitors, and the first compensation switch, corresponding to the first pixel switch, of the compensation switches is turned off.

When the second pixel switch of the pixel switches is turned off, the second compensation switch, corresponding to the second pixel switch, of the compensation switches will be turned on, so that the compensation current equal to the pixel current will flow from the voltage buffer to the second compensation current source, coupled in series to the second compensation switch, of the compensation current sources, and there is no current passing through the second pixel capacitor, coupled in series to the second pixel switch, of the pixel capacitors.

That is to say, when the second pixel switch is turned off, since the compensation current flowing from the voltage buffer to the second compensation current source is equal to the pixel current, there is no jitter occurred in the output voltage of the voltage buffer.

Compared to the prior art, the display apparatus and the voltage stabilization method of the invention can turn on the compensation switch corresponding to the pixel switch, so that the compensation current can flow from the voltage buffer to the compensation current source coupled to the compensation switch, and the compensation current will be equal to the pixel current flowing to the pixel capacitor, so that the output voltage of the voltage buffer has no jitter. Therefore, when each pixel switch performs voltage sampling, the voltage buffer does not need to calibrate its output current, so it can effectively achieve the effect of output voltage stabilization.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A display apparatus, comprising:

a voltage buffer, configured to receive a ramp voltage and output an output current;

a display panel comprising pixel switches and pixel capacitors, wherein the pixel switches are arranged in parallel and coupled to the voltage buffer, and the pixel capacitors are coupled between the pixel switches and ground respectively; and a pixel loading compensation circuit comprising compensation switches and compensation current sources, wherein the compensation switches corresponding to the pixel switches are arranged in parallel and coupled to the voltage buffer, and the compensation current sources are coupled between the compensation switches and ground respectively;

wherein an operation of the compensation switches is opposite to that of the pixel switches corresponding to the compensation switches.

2. The display apparatus of claim 1, wherein when a first pixel switch of the pixel switches is turned on, a pixel current flows from the voltage buffer to a first pixel capacitor, coupled in series with the first pixel switch, of the pixel capacitors, and a first compensation switch, corresponding to the first pixel switch, of the compensation switches is turned off.

3. The display apparatus of claim 1, wherein when a second pixel switch of the pixel switches is turned off, a second compensation switch, corresponding to the second pixel switch, of the compensation switches is turned on, so that a compensation current equal to the pixel current flows from the voltage buffer to a second compensation current source, coupled in series with the second compensation switch, of the compensation current sources, and there is no current passing through a second pixel capacitor, coupled in series with the second pixel switch, of the pixel capacitors.

4. The display apparatus of claim 3, wherein when the second pixel switch is turned off, the compensation current flowing from the voltage buffer to the second compensation current source is equal to the pixel current, so that an output voltage of the voltage buffer does not appear to be jittery.

5. The display apparatus of claim 1, wherein the ramp voltage is provided to the voltage buffer by a ramp source driver.

6. The display apparatus of claim 1, wherein the display panel is an organic light-emitting diode (OLED) panel.

7. A voltage stabilization method, applied to a display apparatus, the display apparatus comprising a voltage buffer, a display panel and a pixel loading compensation circuit, the display panel comprising pixel switches and pixel capacitors, the pixel switches being coupled to the voltage buffer in parallel with each other, and the pixel capacitors being coupled between the pixel switches and ground respectively, the pixel loading compensation circuit comprising compensation switches and compensation current sources, the voltage stabilization method comprising steps of:

coupling the compensation switches, corresponding to the pixel switches, in parallel to the voltage buffer;

coupling the compensation current sources between the compensation switches and ground respectively; and when the voltage buffer receives the ramp voltage and outputs an output current, the operation of compensation switches being opposite to the operation of corresponding pixel switches.

8. The voltage stabilization method of claim 7, wherein when a first pixel switch of the pixel switches is turned on, a pixel current flows from the voltage buffer to a first pixel capacitor, coupled in series with the first pixel switch, of the pixel capacitors, and a first compensation switch, corresponding to the first pixel switch, of the compensation switches is turned off.

9. The voltage stabilization method of claim 7, wherein when a second pixel switch of the pixel switches is turned off, a second compensation switch, corresponding to the second pixel switch, of the compensation switches is turned on, so that a compensation current equal to the pixel current flows from the voltage buffer to a second compensation current source, coupled in series with the second compensation switch, of the compensation current sources, and there is no current passing through a second pixel capacitor, coupled in series with the second pixel switch, of the pixel capacitors.

10. The voltage stabilization method of claim 9, wherein when the second pixel switch is turned off, the compensation current flowing from the voltage buffer to the second compensation current source is equal to the pixel current, so that an output voltage of the voltage buffer does not appear to be jittery.

11. The voltage stabilization method of claim 7, wherein the ramp voltage is provided to the voltage buffer by a ramp source driver.

12. The voltage stabilization method of claim 7, wherein the display panel is an organic light-emitting diode (OLED) panel.

* * * * *